United States Patent [19]

Jacob et al.

[11] 4,162,668

[45] Jul. 31, 1979

[54] DIESEL INTERNAL COMBUSTION ENGINE

[75] Inventors: Karl Jacob, Friedrichshafen; Franz Edmaier, Markdorf; Robert Schulmeister; Stefan Walz, both of Friedrichshafen, all of Fed. Rep. of Germany

[73] Assignee: Motoren- und Turbinen-Union Friedrichshafen GmbH, Fed. Rep. of Germany

[21] Appl. No.: 816,186

[22] Filed: Jul. 15, 1977

[30] Foreign Application Priority Data

Jul. 16, 1976 [DE] Fed. Rep. of Germany ..... 2632015

[51] Int. Cl.[2] ..... F02N 17/00; F02B 33/00; F02M 23/04

[52] U.S. Cl. ..... 123/179 F; 123/119 C; 123/124 R; 123/26; 60/626; 60/627

[58] Field of Search ..... 123/179 G, 119 C, 179 F, 123/124 R, 26 R; 60/625, 626, 627

[56] References Cited

U.S. PATENT DOCUMENTS

| | | | |
|---|---|---|---|
| 2,236,634 | 4/1941 | Yamashita | 123/179 F |
| 3,626,918 | 12/1971 | Brenneke | 123/179 G |
| 3,792,691 | 2/1974 | Sahnas | 123/26 R |
| 3,921,403 | 11/1975 | McInerney et al. | 123/119 C |
| 3,964,451 | 6/1976 | Goto | 123/26 |
| 3,991,729 | 11/1976 | Notaro | 123/124 R |
| 4,006,722 | 2/1977 | Hata et al. | 123/124 R |

*Primary Examiner*—Charles J. Myhre
*Assistant Examiner*—Magdalen Moy
*Attorney, Agent, or Firm*—Craig and Antonelli

[57] ABSTRACT

A multi-cylinder diesel internal combustion engine with a supercharger and a charging air starting arrangement which includes a starting air reservoir and a starting air distributor. An additional air reservoir is provided for storing a quantity of supplemental charging air with the additional air reservoir being selectively communicated with air inlet valves during at least an acceleration and/or sudden loading of the engine.

11 Claims, 1 Drawing Figure

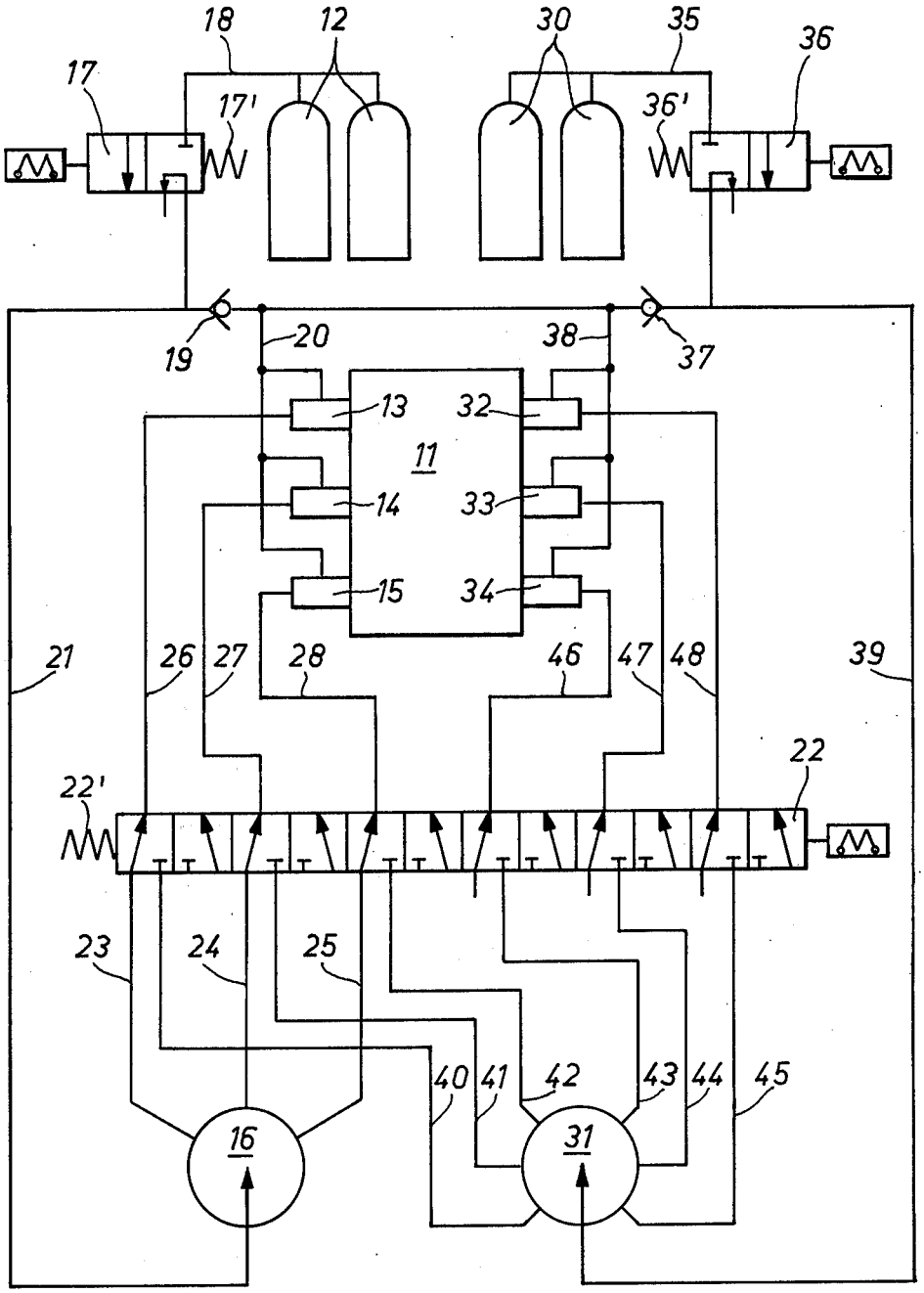
18
12
30
35
36
17
17'
36'
19
20
38
37
13
32
11
14
33
15
34
21
26
27
28
46
47
48
39
22
22'
23
24
25
40
41
42
43
44
45
16
31

DIESEL INTERNAL COMBUSTION ENGINE

The present invention relates to an internal combustion engine and, more particularly, to a diesel internal combustion engine which includes an exhaust gas turbo-supercharger and a compressed air starting arrangement having a starting air reservoir selectively communicating with at least a portion of air intake valves associated with respective cylinders of the engine and a starting air distributor, driven by the engine, for distributing and/or dividing the control air to the air inlet valves of the respective cylinders during power strokes.

A regulating arrangement for a supercharged diesel internal combustion engine is disclosed, for example, in German Patent No. 22 21 567, wherein a supply of starting air from a starting air reservoir is directed to the engine during acceleration of the engine and/or during a reduction of the rotative speed due to a sudden load increase of the internal combustion engine operating on fuel in the range of over 50% of the fuel load rotative speed.

The purpose of the afore-mentioned regulating arrangement resides in compensating, during an accelerating process and/or during a sudden load increase, for the lack of an adequate supply of charging air being delivered to the respective cylinders of the engine by the exhaust gas turbo-supercharger during such operating conditions. One disadvantage of the proposed regulating arrangement resides in the fact that, by supplying compressed air from the starting air reservoir, the compensation for lack of an adequate supply of charging air is only partially achieved since the delivery of compressed air through a control valve occurs during the power stroke of the respective cylinders so that fresh charging air supplied is discharged to the atmosphere together with a subsequent discharge of the exhaust gases, whereby the largest proportion of the supplied charging air does not participate in the combustion process.

Additionally, after a starting operation of an engine equipped with the proposed regulating arrangement, the pressure level in the starting air reservoir is reduced by the amount of air consumed during the starting of the engine. Thus, for an accelerating process of the engine, from a no load rotative speed to a full load rotative speed, which is normally required subsequent to starting, the maximum possible air pressure necessary for achieving an efficient operation of the engine is not available. Consequently, the primary effect of the compressed air on the piston is decreased and the supply of the compressed or charging air at the end of the power stroke occurs only at a later point in time when there has been a corresponding decrease in the combustion pressure in the respective cylinders. Moreover, in such construction, the desirable cooling effect of the charging air on the temperature level in the respective cylinders is considerably reduced.

The aim underlying the present invention essentially resides in providing a supercharged diesel internal combustion engine which provides an adequate supply of charging air to the engine during an acceleration process and/or a sudden loading.

According to one feature of the present invention, in addition to providing a starting air reservoir and starting air distributor, an additional separate air reservoir is provided which selectively communicates with air intake valves of the engine so that a quantity of supplemental air supplies the full charging air pressure to the engine directly after a starting operation thereof so as to ensure the adequate supply of charging air.

According to another feature of the present invention, a second air control distributor is provided for distributing and/or dividing the supplemental compressed air from the additional air reservoir to the respective cylinders of the engine when the intake or suction valve is normally open, i.e., during an intake stroke and in the first third of the compression stroke. By virtue of this arrangement, supplemental air is apportioned, whereby any lack of a sufficient quantity of charging air is completely compensated for during an acceleration process and/or during a sudden loading of the engine.

Moreover, by virtue of the arrangement of the present invention, the relatively long time period normally required for a diesel internal combustion engine to proceed from the lowest rotational speed to the rated speed of rotation is reduced and a considerable reduction in the time of a rotative speed drop due to a sudden load increase on the running engine is also achieved.

Accordingly, it is an object of the present invention to provide a diesel internal combustion engine which avoids by simple means the shortcomings and disadvantages encountered in the prior art.

Another object of the present invention resides in providing a diesel internal combustion engine which ensures an adequate supply of charging air to the cylinders of the engine during an acceleration process and/or during a sudden load increase on the engine.

A further object of the present invention resides in providing a diesel internal combustion engine which functions reliably under all operating conditions.

Yet another object of the present invention resides in providing a diesel internal combustion engine which precisely regulates the supply of charging air to the engine, yet minimizes the number of parts therefor.

These and other objects, features and advantages of the present invention will become more apparent from the following description when taken in connection with the accompanying drawing which shows, for the purposes of illustration only, one embodiment in accordance with the present invention, and wherein:

The single FIGURE is a schematic view of a diesel internal combustion engine in accordance with the present invention.

Referring now to the drawing, a six-cylinder diesel internal combustion engine 11 having an exhaust gas turbo-supercharger is provided with a compressed air starting system which includes a starting air reservoir 12, air intake valves 13, 14, 15, and a starting air distributor 16. During a starting operation of the diesel internal combustion engine 11, compressed charging air is delivered from the starting air reservoir 12 through a line 18, selectively operable magnetic valve 17, check valve 19 and a line 20 to the air inlet valves 13, 14, 15 and by a line 21 to starting air distributor 16 driven by the diesel internal combustion engine 11.

The starting air distributor 16 distributes and/or divides the compressed air, as control air, through a second selectively operable magnetic valve 22 and lines 23, 24, 25 as well as lines 26, 27, 28 to the air inlet valves 13, 14, 15. By this arrangement, the compressed air in line 20 is injected through the respective air intake valves 13, 14, 15 to their associated cylinder during a power stroke with the compressed charging air acting on the associated piston for starting the diesel internal combustion engine 11.

A further air reservoir 30 is provided and is rendered operable during an acceleration and shock loading phases of the diesel internal combustion engine so as to deliver compressed charging air into the cylinders through normally opened inlet or suction valves during an intake stroke and in the first third of the compression stroke by way of the air intake valves 13, 14, 15 and further air inlet valves 32, 33, 34.

The compressed air flows from the air reservoir 30 through a line 35, a selectively operable magnetic valve 36, check valve 37, and lines 20, 38 to the air inlet valves 13, 14, 15 and 32, 33, 34 and through a line 39 to a second control air distributor 31 which is also driven by the diesel internal combustion engine 11. The control air distributor 31 distributes and/or divides the compressed air, as control air, through the selectively operable magnetic valve 22 and compressed air lines 40–45, 26–28 and 46–48 to the air inlet valves 13–15 and 32–34.

In operation, the magnetic valve 17 is actuated so that compressed charging air is delivered from the starting air reservoir 12 through lines 18, check valve 19, lines 20, 21, air distributor 16, lines 23, 24, 25, magnetic valve 22, and lines 26, 27, 28 to the air inlet valves 13, 14, 15 and is injected into the cylinders during at least a portion of the power stroke. The magnetic valve remains operative until the attainment of a starting rotative speed of about 100 to 150 rpm. Above this rotative speed, the current to the magnetic valve is interrupted and the spring 17' displaces the valve to the position illustrated in the drawing so as to interrupt the delivery of compressed air from the starting air reservoir 12 to the respective cylinders of the engine 11. Upon the interruption of current to the magnetic valve 17, the magnetic valves 22 and 36 are actuated and compressed charging air from the additional air reservoir 30 is delivered to the line 35, check valve 37, lines 38 and 39, air distributor 31, lines 40–45, magnetic valve 22, lines 26–28, and lines 46–48 to the air inlet valves 13, 14, 15 and additional air inlet valves 32, 33, 34 and is preferably injected into all of the cylinders during a suction and compression stroke.

After the diesel internal combustion engine 11 reaches an establishable rotative speed which is slightly below the rated speed, the current to the magnetic valves 22, 36 is interrupted and the springs 22', 36', respectively, displace the valves 22, 36 to the positions illustrated in the drawing, thereby interrupting the delivery of supplemental compressed air to the cylinders of the engine 11.

Once the diesel internal combustion engine 11 has attained the last-mentioned rotative speed, the exhaust gas turbo-supercharger is then effected to fully take over the charging of the engine. As soon as the rotative speed of the engine 11 decreases below the rated rotative speed due, for example, to a sudden loading, the supplemental compressed air is again delivered to the air intake valves 13, 14, 15 and additional air intake valves 32, 33, 34 by the actuation of magnetic valves 36, 22. By this arrangement, a severe decrease of the rotative speed is avoided and it is possible to quickly return the diesel internal combustion engine 11 to the rated rotative speed.

During the normal operation of the diesel internal combustion engine 11, the exhaust gas turbo-charger is effective so that the two compressed charging air reservoirs 12, 30 are filled to a nominal pressure so that a sufficient quantity of air at an adequate charging pressure is available for the next starting and/or acceleration process of the engine 11.

While we have shown and described only one embodiment in accordance with the present invention, it is understood that the same is not limited thereto, but is susceptible of numerous changes and modifications as known to a person skilled in the art, and we therefor do not wish to be limited to the details shown and described herein, but intend to cover all such changes and modifications as are encompassed by the scope of the appended claims.

We claim:

1. A multi-cylinder diesel internal combustion engine with a supercharger means and a charging air starting means including a starting air reservoir means, and means for selectively communicating said starting air reservoir means with at least some air inlet valves associated with cylinders of the engine during a starting operation of the engine, the improvement comprising:

an additional air reservoir means for storing a quantity of supplemental charging air, means for selectively communicating said additional air reservoir means with the air inlet valves during at least one of an acceleration of the engine and a sudden loading of the engine, the air inlet valves include a first set of air inlet valves and a second set of air inlet valves, and wherein said starting air reservoir means selectively communicates with only said first set of air inlet valves and said additional air reservoir means selectively communicates with both said first and second sets of air inlet valves.

2. A multi-cylinder diesel internal combustion engine according to claim 1, wherein the charging air starting means further includes a starting air distributor means communicating with the starting air reservoir means and the air inlet valves, and wherein a further air distributor means is provided and communicates with said additional air reservoir means and the air inlet valves.

3. A multi-cylinder diesel internal combustion engine according to claim 2, wherein said means for selectively communicating said additional air reservoir means with the air inlet valves includes charging air lines arranged between the additional air reservoir means, the air inlet valves, and the further air distributor means and between the further air distributor means and the air inlet valves, and selectively operable electromagnetic valve means arranged in the charging air lines, said electromagnetic valve means in a first position communicating said additional reservoir means with said further air distributor means and the air inlet valves and, in a second position interrupting the flow of supplemental charging air to the engine.

4. A multi-cylinder diesel internal combustion engine according to claim 3, wherein said electromagnetic valve means includes a first electromagnetic valve arranged in the charging air lines between the additional air reservoir means, air inlet valves, and further air distributor means, and a second electromagnetic valve arranged in the charging air lines between said further air distributor means and the air inlet valves.

5. A multi-cylinder diesel internal combustion engine according to claim 1, wherein said means for selectively communicating the starting air reservoir means includes charging air lines, selectively operable valve means are arranged in the charging air lines, the charging air lines are arranged between the starting air reservoir means, the air inlet valves and the starting air distributor, and between the starting air distributor and the air inlet valves, and wherein a further selectively operable valve means is arranged in said charging air lines between said starting air reservoir means, the air inlet valves and said starting air distributor means.

6. A multi-cylinder diesel internal combustion engine according to claim 5, wherein check valve means are arranged in the charging air lines and the further charging air lines between said first electromagnetic valve, the further electromagnetic valve means and the air inlet valve means.

7. A multi-cylinder diesel internal combustion engine according to claim 1, wherein said additional air reservoir means communicates with the air inlet valves during an intake stroke and a first third of a compression stroke of a cylinder associated with a respective air inlet valves.

8. A multi-cylinder diesel internal combustion engine according to claim 1, wherein said additional air reservoir means communicates with the first and second sets of air inlet valves during an intake stroke and a first third of a compression stroke of a cylinder associated with a respective air inlet valve.

9. A multi-cylinder diesel internal combustion engine with a supercharger means and a charging air starting means including a starting air reservoir means, and means for selectively communicating said starting air reservoir means with at least some air inlet valves associated with cylinders of the engine during a starting operation of the engine, the improvement comprising:

an additional air reservoir means for storing a quantity of charging air, means for selectively communicating said additional air reservoir means with the air inlet valves during at least one of an acceleration of the engine and a sudden loading of the engine, said charging air starting means further includes a starting air distributor means communicating with the starting air reservoir means and the inlet valve means, a further air distributor means as provided and communicates with said additional air reservoir means and the air inlet valves, said means for selectively communicating said additional air reservoir means with the air inlet valves includes charging air lines arranged between the additional air reservoir means, the air inlet valves, and the further air distributor means and between the further air distributor means and the air inlet valves, selectively operable electromagnetic valve means arranged in the charging air lines, said electromagnetic valve means in a first position communicating said additional reservoir means with said further air distributor means and the air inlet valves and, in a second position, interrupting the flow of supplemental charging air to the engine, said electromagnetic valve means includes a first electromagnetic valve arranged in the charging air lines between the additional air reservoir means, air inlet valves, and further air distributor means, and a second electromagnetic valve arranged in the charging air lines between said further air distributor means and the air inlet valves, said means for selectively communicating the starting air reservoir means includes further charging air lines arranged between the starting air reservoir means, the air inlet valves and the starting air distributor, and between the starting air distributor and the air inlet valves, said second electromagnetic valve being arranged in the further charging airlines between said starting air distributor means and the air inlet valves, a further electromagnetic valve means is arranged in said further charging air lines between said starting air reservoir means, the air inlet valves and said starting air distributor means, the air inlet valves include a first set of air inlet valves and a second set of air inlet valves, and wherein said starting air reservoir means selectively communicates with only said first set of air inlet valves and said additional air reservoir means selectively communicates with both said first and second sets of air inlet valves.

10. A multi-cylinder diesel internal combustion engine according to claim 9, wherein said additional air reservoir means communicates with the first and second sets of air inlet valves during an intake stroke and a first third of a compression stroke of a cylinder associated with a respective air inlet valve.

11. A multi-cylinder diesel internal combustion engine according to claim 10, wherein check valve means are arranged in the charging air lines and the further charging air lines between said first electromagnetic valve, the further electromagnetic valve means and the air inlet valves.

* * * * *